US008644545B2

(12) United States Patent
Akino

(10) Patent No.: US 8,644,545 B2
(45) Date of Patent: Feb. 4, 2014

(54) CONDENSER MICROPHONE UNIT AND CONDENSER MICROPHONE

(75) Inventor: Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 50 days.

(21) Appl. No.: 13/427,075

(22) Filed: Mar. 22, 2012

(65) Prior Publication Data

US 2012/0250926 A1 Oct. 4, 2012

(30) Foreign Application Priority Data

Mar. 29, 2011 (JP) ..... 2011-072316

(51) Int. Cl.
*H04R 19/04* (2006.01)

(52) U.S. Cl.
USPC ..... 381/355; 381/174; 181/171

(58) Field of Classification Search
USPC ..... 381/174, 111, 113, 355, 361, 369; 181/158, 171
See application file for complete search history.

(56) References Cited

FOREIGN PATENT DOCUMENTS

JP 2008-72271 3/2008
JP 2009-124682 A * 6/2009 ..... H04R 19/04

* cited by examiner

*Primary Examiner* — Curtis Kuntz
*Assistant Examiner* — Joshua Kaufman
(74) *Attorney, Agent, or Firm* — Whitham, Curtis, Christofferson & Cook, P.C.

(57) ABSTRACT

A condenser microphone unit includes a diaphragm, a diaphragm ring, a fixed electrode, a casing unit accommodating the diaphragm ring, the diaphragm, and the fixed electrode. A condenser microphone includes the condenser microphone unit. The diaphragm ring is indirectly fixed to the interior of the unit casing through a fixing ring fixed to the unit casing. The fixing ring has a planar ring portion and a plurality of projections projecting from the internal periphery of the ring portion and provided in a circumferential direction. The plurality of projections urges the diaphragm ring toward the fixed electrode.

20 Claims, 6 Drawing Sheets

CONDENSER MICROPHONE UNIT AND CONDENSER MICROPHONE

BACKGROUND OF THE INVENTION

1. Field of the Invention

The present invention relates to a condenser microphone unit and a condenser microphone including the condenser microphone unit, the condenser microphone unit preventing a variation in tension of a diaphragm even if a diaphragm ring is fixed through a fixing ring and securely making an electric connection between the diaphragm ring and the fixing ring.

2. Related Background Art

Main components of a condenser microphone unit include a diaphragm supported by a diaphragm ring and a fixed electrode provided opposite to the diaphragm with a gap corresponding to the thickness of a spacer provided therebetween, as disclosed in Japanese Unexamined Patent Application Publication No. 2008-072271.

A conventional condenser microphone unit is illustrated in FIGS. 4 to 6. The conventional example depicts a unidirectional condenser microphone unit having two diaphragms in the front and back.

With reference to FIG. 4, a condenser microphone unit 1 has a unit casing 15 including an insulating washer 6 that divides the inside thereof into two sections. A front microphone element 20 is provided in the front (upper side in FIG. 4) of the insulating washer 6 and a back microphone element 30 is provided in the back (lower side in FIG. 4) thereof.

The microphone element 20 has a front sound terminal (not shown in the drawing) provided in the unit casing 15, a front diaphragm ring 4 accommodated in the unit casing 15, a front diaphragm 11 held by the front diaphragm ring 4, a front fixing ring 41 fixing the front diaphragm ring 4 to the unit casing 15, a front fixed electrode 8 provided opposite to the front diaphragm 11 through a spacer 46 with a predetermined gap therebetween, and a front air chamber 18 provided in the back of the front fixed electrode 8.

The microphone element 30 has a back sound terminal (not shown in the drawing) provided in the unit casing 15, a back diaphragm ring 5 accommodated in the unit casing 15, a back diaphragm 12 held by the back diaphragm ring 5, a back fixing ring 51 fixing the back diaphragm ring 5 to the unit casing 15, a back fixed electrode 9 provided opposite to the back diaphragm 12 through a spacer 47 with a predetermined gap therebetween, and a back air chamber 19 provided in the front of the back fixed electrode 9.

The front fixing ring 41 is a thin ring plate having a plurality of screw holes 43 to allow the front diaphragm ring 4 to be fixed by screws 42 without requiring screw holes directly in the front diaphragm ring 4. The front fixing ring 41 is fixed to the unit casing 15 with the screws 42. Then, the internal end portion of the front fixing ring 41 urges and fixes the front diaphragm ring 4 to the front fixed electrode 8. The front diaphragm ring 4 is thus indirectly fixed to the unit casing 15. Similar to the front diaphragm ring 4, the back diaphragm ring 5 is indirectly fixed to the unit casing 15 by the back fixing ring 51. The front fixing ring 41 and the back fixing ring 51 are each composed of a metal plate to provide conductivity.

The insulating washer 6 has a sound hole 7 to connect the front air chamber 18 and the back air chamber 19. Although only one sound hole 7 is depicted in FIG. 4, a plurality of sound holes 7 is provided in practice.

In such a conventional condenser microphone unit, sound waves received through the back sound terminal pass through the sound holes 7 in the insulating washer 6. The sound waves are then directed to the front air chamber 18 in the back of the front fixed electrode 8 and reach the back portion of the front diaphragm 11 to provide unidirectivity to the diaphragm 11. The front air chamber 18 in the back of the front fixed electrode 8 provides an omnidirectional driving force, while the sound waves from the back sound terminal provide a bidirectional driving force. At the bidirectional driving force equal to the omnidirectional driving force, unidirectivity is achieved where the sound collection direction is cardioid. The principal to achieve unidirectivity in the back diaphragm 12 is the same as that in the above-described front diaphragm 11 except that the relevant components are reversed between the front and back, thus the explanation is omitted.

In the condenser microphone unit described above, the opposing diaphragm and fixed electrode define a capacitor. The diaphragm vibrates in response to sound waves. Then, the gap between the diaphragm and the fixed electrode varies, thus varying the capacitance of the capacitor. The variation in capacitance is output as audio signals associated with variable voltage. The diaphragm is fixed to the diaphragm ring and accommodated under an appropriate tension in the unit casing.

A variation in tension of the diaphragm causes a variation in frequency response of the microphone unit. A main factor to cause the variation in tension of the diaphragm is a mechanical stress exerted on the diaphragm ring in the assembled microphone unit.

In particular, in the case where the diaphragm ring is indirectly fixed to the unit casing using the fixing ring fixed by the screws as described above, the urging force from the fixing ring is exerted unevenly on the diaphragm ring. Such uneven urging force may vary the tension of the diaphragm. Depending on the urged position of the diaphragm ring by the fixing ring, the diaphragm ring may be deformed or tilted inward or outward, thus causing a variation in tension of the diaphragm.

Furthermore, the diaphragm ring is fixed to the diaphragm and functions as an electrode provided opposite to the fixed electrode. Thus, the diaphragm ring and the fixing ring should be securely connected electrically. As described above, however, the uneven urging force from the fixing ring to the diaphragm ring may result in an unstable electric connection.

SUMMARY OF THE INVENTION

In view of the circumstances above, an object of the present invention is to provide a condenser microphone unit preventing a variation in tension of a diaphragm ring and securely making an electric connection between the diaphragm ring and a fixing ring, the condenser microphone unit having a structure in which the diaphragm ring is fixed through the fixing ring.

The present invention provides a condenser microphone unit including a diaphragm; a diaphragm ring holding the diaphragm at a predetermined tension; a fixed electrode provided opposite to the diaphragm with a gap therebetween, the fixed electrode and the diaphragm defining a capacitor; and a unit casing accommodating the diaphragm ring, the diaphragm, and the fixed electrode. The diaphragm ring is indirectly fixed to the interior of the unit casing through a fixing ring screwed to the unit casing, the fixing ring including a planar ring portion and a plurality of projections projecting from an internal periphery of the ring portion and provided in a circumferential direction at equal distances. The plurality of projections urges the diaphragm ring toward the fixed electrode. The present invention further provides a condenser microphone including the condenser microphone unit.

DESCRIPTION OF THE PREFERRED EMBODIMENTS

Figure 1:
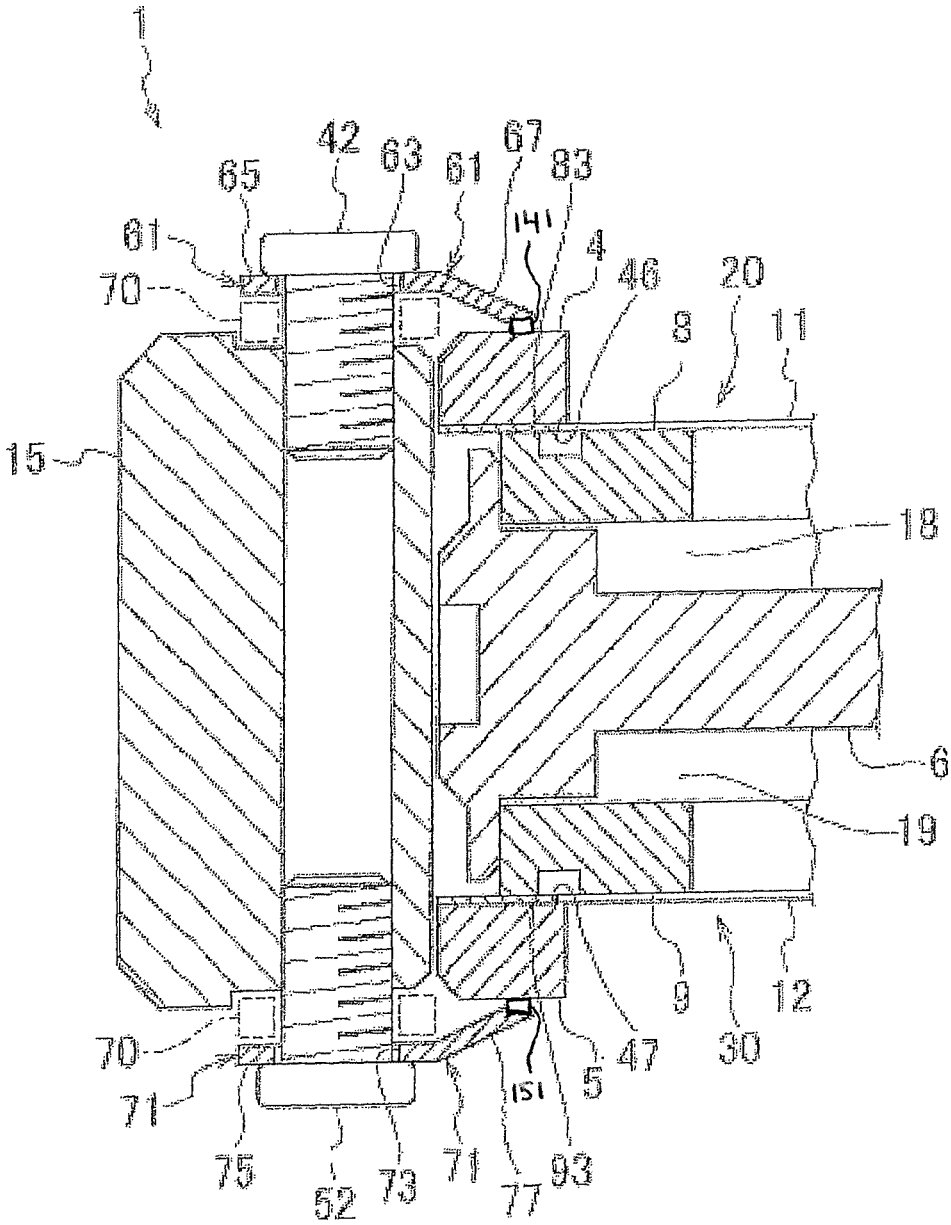
FIG. 1 is a vertical cross-sectional view illustrating the main portion of a condenser microphone unit according to an embodiment of the present invention.

A condenser microphone unit and condenser microphone according to an embodiment of the present invention is described below with reference to FIGS. 1, 2A 2B, 3A and 3B. The condenser microphone unit according to the embodiment has a different structure from the conventional condenser microphone unit described above with respect to a fixing ring that indirectly fixes a diaphragm ring to a unit casing, but has a similar structure to the conventional condenser microphone unit with respect to other components. Thus, the description focuses on a portion pertaining to the fixing and its vicinity. Components similar to those in the conventional condenser microphone unit are denoted with the same reference numerals.

With respect to FIG. 1, a condenser microphone unit 1 of the embodiment has a unit casing 15 including an insulating washer 6 that divides the inside thereof into two sections. A front microphone element 20 is provided in the front (upper side in FIG. 1) of the insulating washer 6 and a back microphone element 30 is provided in the back (lower side in FIG. 1) thereof. The condenser microphone unit in the embodiment is provided with two microphone elements in the front and back. The present invention, however, is not limited to the embodiment, and one microphone element alone may be provided.

The microphone element 20 has a front sound terminal (not shown in the drawing) provided in the unit casing 15, a front diaphragm ring 4 accommodated in the unit casing 15, a front diaphragm 11 held by the front diaphragm ring 4, a front fixing ring 61 fixing the front diaphragm ring 4 to the unit casing 15, a front fixed electrode 8 provided opposite to the front diaphragm 11 through a spacer 46 with a predetermined gap therebetween, and a front air chamber 18 provided in the back of the front fixed electrode 8. The front fixing ring 61, which is composed of a resilient conductive metal plate, urges the front diaphragm ring 4 toward a support projection 83 of the front fixed electrode 8 through the spacer 46.

The microphone element 30 has a back sound terminal (not shown in the drawing) provided in the unit casing 15, a back diaphragm ring 5 is accommodated in the unit casing 15, a back diaphragm 12 held by the back diaphragm ring 5, a back fixing ring 71 fixing the back diaphragm ring 5 to the unit casing 15, a back fixed electrode 9 provided opposite to the back diaphragm 12 through a spacer 47 with a predetermined gap therebetween, and a back air chamber 19 provided in the front of the back fixed electrode 9. The back fixing ring 71, which is composed of a resilient conductive metal plate, urges the back diaphragm ring 5 toward a support projection 93 of the back fixed electrode 9 through the spacer 47.

The insulating washer 6 has a plurality of sound holes (not shown in the drawing) to connect the front air chamber 18 and the back air chamber 19.

In the embodiment above, the sound waves received through the back sound terminal pass through the sound holes (not shown in the drawing) in the insulating washer 6. The sound waves are then directed to the front air chamber 18 in the back of the front fixed electrode 8 and reach the back portion of the front diaphragm 11 to provide unidirectivity to the diaphragm 11. The front air chamber 18 in the back of the front fixed electrode 8 provides an omnidirectional driving force, while the sound waves from the back sound terminal provide a bidirectional driving force. At the bidirectional driving force equal to the omnidirectional driving force, unidirectivity is achieved where the sound collection direction is cardioid. The principal to achieve unidirectivity in the back diaphragm 12 is the same as that in the above-described front diaphragm 11 except that the relevant components are reversed between the front and back, thus the explanation is omitted.

In the embodiment, the shape of the front fixing ring 61 and the back fixing ring 71 is different from that in the conventional example above. The front fixing ring 61 is described below. The back fixing ring 71 has the same shape and effects as the front fixing ring 61, and thus descriptions thereof are omitted.

Figure 2A:
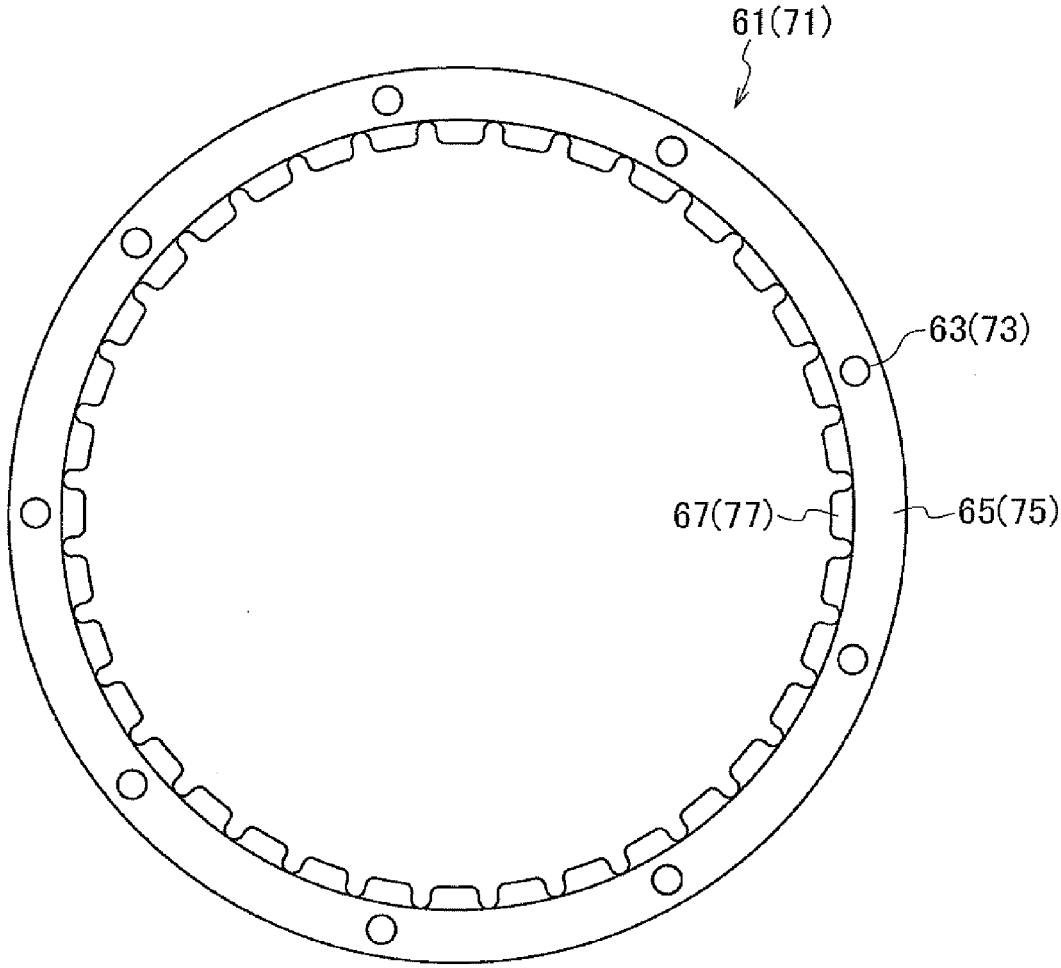
FIGS. 2A and 2B are a plan view and a central cross-sectional view, both of a fixing ring included in the condenser microphone unit.
Figure 2B:
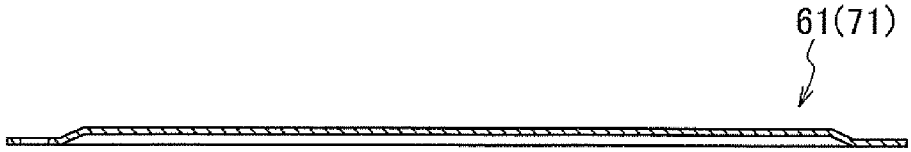

With reference to FIGS. 1, 2A, and 2B, the front fixing ring 61 is a thin ring plate having a plurality of screw holes 63 to allow the front diaphragm ring 4 to be fixed by screws 42 without requiring screw holes directly in the front diaphragm ring 4. The front fixing ring 61 has a planar ring portion 65 and a plurality of projections 67 from the internal periphery of the ring portion 65 toward the front diaphragm ring 4, projecting at a predetermined angle relative to a flat surface of the ring portion 65, and provided in the circumferential direction at equal distances.

In further reference to FIGS. 1, 2A, and 2B, the back fixing ring 71 is a thin ring plate having a plurality of screw holes 73 to allow the back diaphragm ring 5 to be fixed by screws 52 without requiring screw holes directly in the back diaphragm ring 5. The back fixing ring 71 has a planar ring portion 75 and a plurality of projections 77 from the internal periphery of the ring portion 75 toward the back diaphragm ring 5, projecting at a predetermined angle relative to a flat surface of the ring portion 75, and provided in the circumferential direction at equal distances.

The front fixing ring 61 is fixed to the unit casing 15 with the screws 42. Then, the projections 67 of the front fixing ring 61 urge and fix the front diaphragm ring 4 to the front fixed electrode 8. In this state, equal urging forces are exerted by the respective projections 67 on the front diaphragm ring 4, thus effectively preventing a variation in tension of the diaphragm.

In addition, the projections 67 urge the front diaphragm ring 4 to the front fixed electrode 8 at positions opposite to the position where the front diaphragm ring 4 is urged by the support projection 83. Thus, the urging forces from the projections 67 are evenly exerted on the end portion in the width direction (inward/outward direction) of the front diaphragm ring 4. This prevents the diaphragm ring from being deformed or tilted inward or outward, thus effectively preventing a variation or unevenness in tension of the diaphragm.

Furthermore, providing a large number of projections 67 achieves a balanced connection between the front fixing ring 61 and the front diaphragm ring 4 through multiple positions, thus ensuring an electric connection therebetween. Effects of use of the back fixing ring 71 are the same as those of use of the front fixing ring 61.

In the present invention, as described above, urging the diaphragm ring to the fixed electrode by the plurality of projections provided in the fixing ring prevents a variation in tension of the diaphragm ring and ensures an electric connection between the diaphragm ring and the fixing ring in the condenser microphone unit having the structure in which the diaphragm ring is fixed through the fixing ring.

The present invention is not limited to the embodiment above and may be embodied in various modes. For example, a ring metal washer 70, as illustrated by a broken line in FIG. 1, may be provided between the ring portion of the fixing ring and the unit casing. This stabilizes the fixing of the fixing ring to the unit casing by the screws, achieving a further stable fixing of the diaphragm ring.

The plurality of projections provided in the fixing ring 61 may be flush with the ring portion 65 and a projected portion indicated generally as box 141 (and box 151 for the back fixing ring 71) may project from a surface opposite to a surface on which the diaphragm 11 of the diaphragm ring is pasted, continuously along the concentric circle of the diaphragm ring 4, such that the projections 67 of the fixing ring 61 urge the projected portion 141. This also allows the urging forces from the projections 67 to be evenly exerted on the end portion in the width direction (inward/outward direction) of the diaphragm ring 4 through the projected portion 141, similar to the embodiment above, thus preventing the diaphragm ring 4 from being deformed or tilted inward or outward and effectively preventing a variation or unevenness in tension of the diaphragm 11. It is sufficient if the projected portion 141 is in contact with the projections 67 of the fixing ring 61. Thus, a plurality of projected portions 141 may be provided discontinuously at positions corresponding to the projections 67 along the concentric circle at equal distances.

Figure 3A:
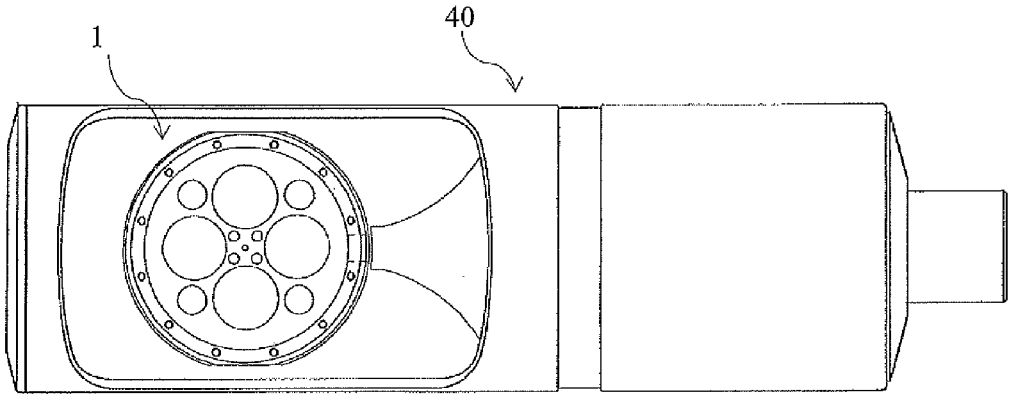
FIGS. 3A and 3B are a front view and a side view, both illustrating a condenser microphone according to the embodiment.
Figure 3B:
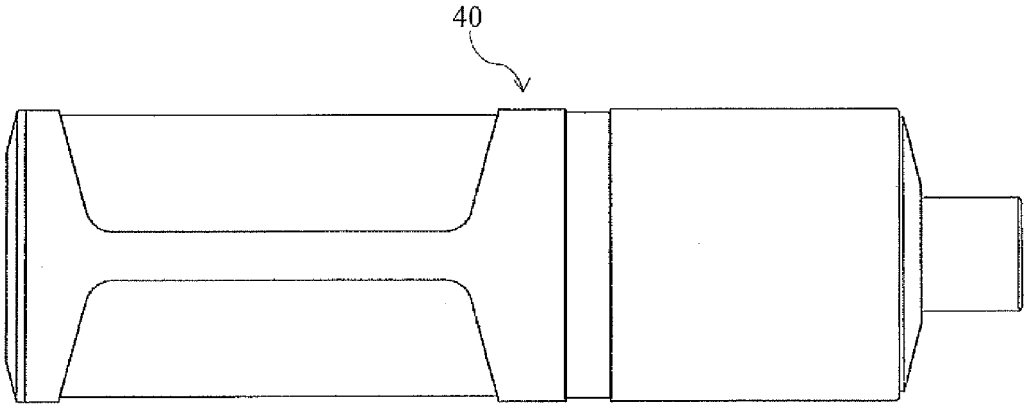
Figure 4:
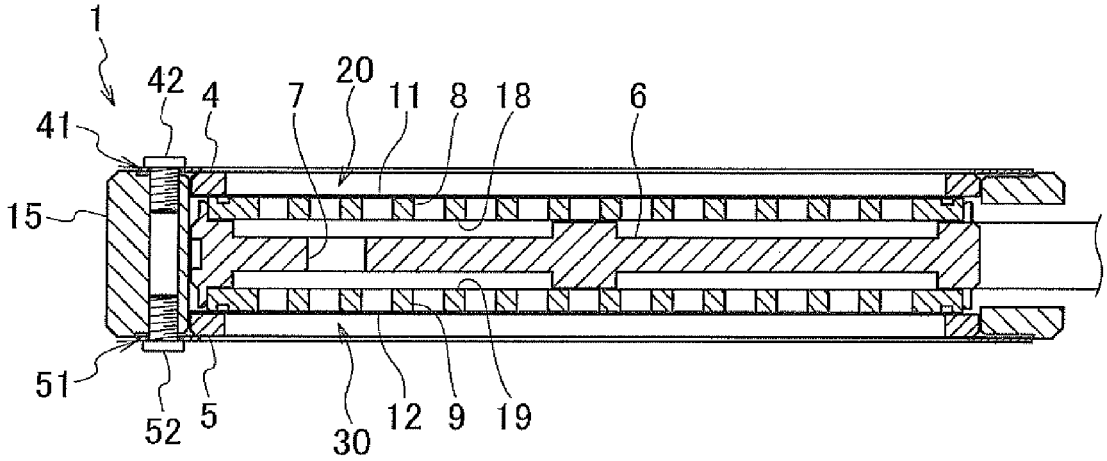
RELATED ART FIG. 4
FIG. 4 is a vertical cross-sectional view illustrating a conventional condenser microphone unit.
Figure 5:
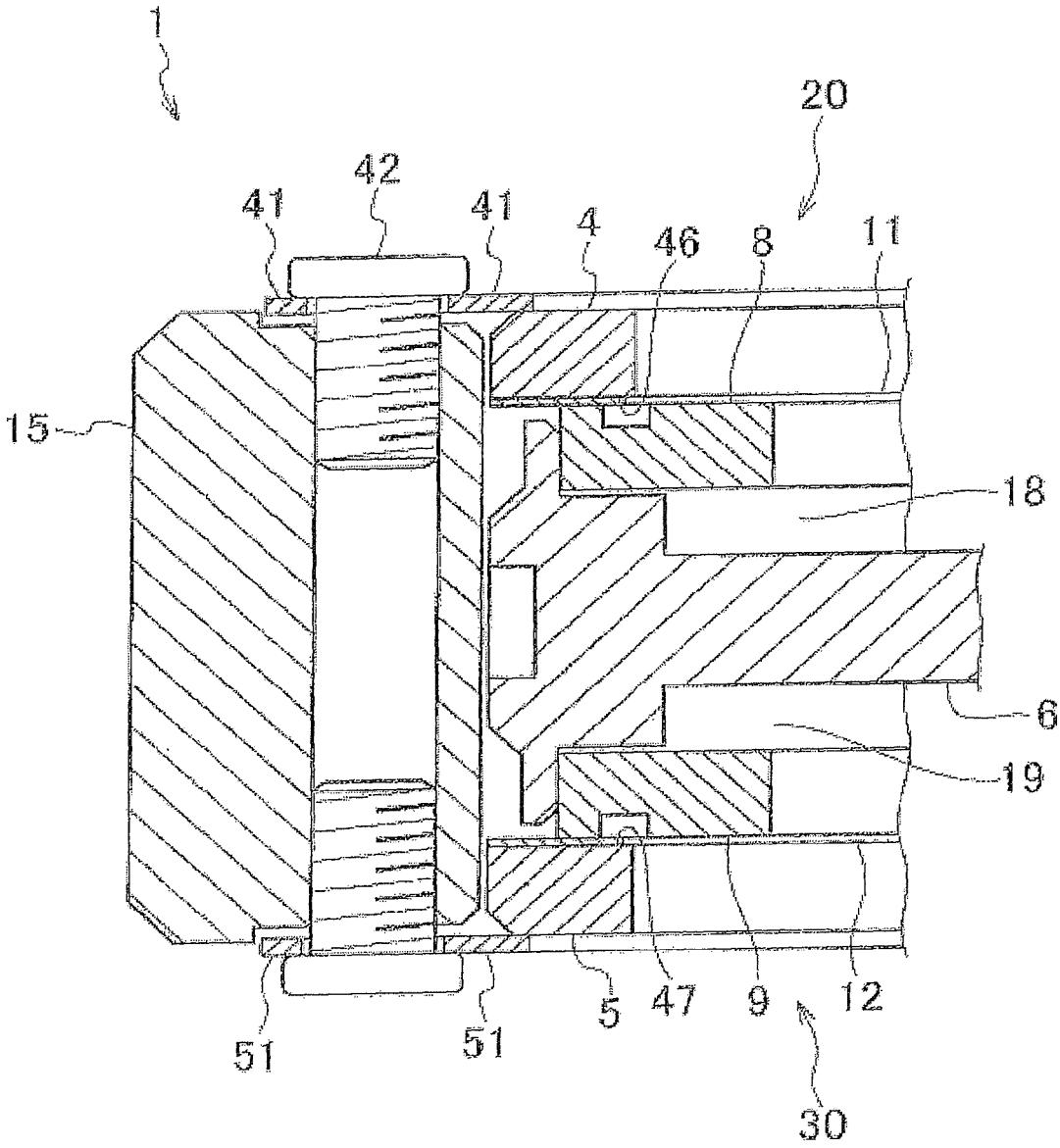
RELATED ART FIG. 5
FIG. 5 is a vertical cross-sectional view of the main portion of the conventional condenser microphone unit.
Figure 6:
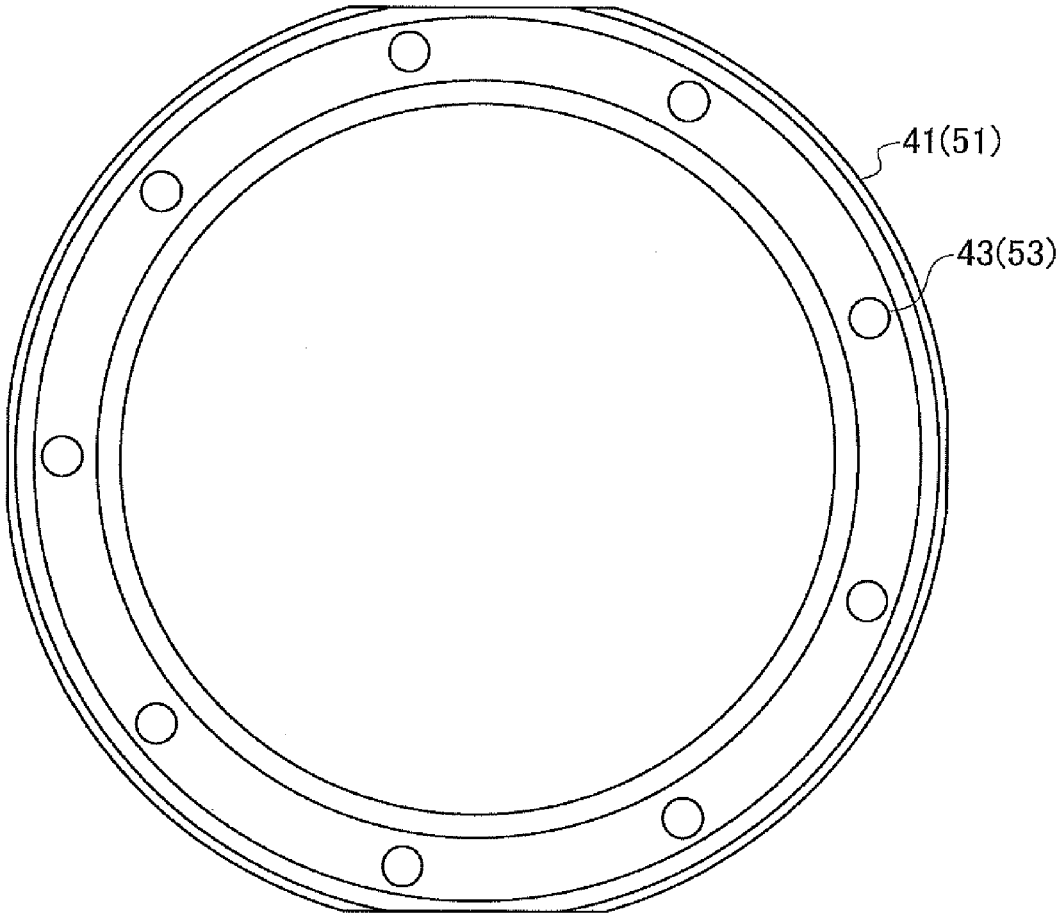
RELATED ART FIG. 6
FIG. 6 is a plan view of a fixing ring included in the conventional condenser microphone unit.

With reference to FIGS. 3A and 3B, a condenser microphone 40 including the condenser microphone unit 1 described above also has the same advantageous effects as the condenser microphone unit 1.

What is claimed is:

1. A condenser microphone unit comprising:

a diaphragm pasted to a first surface of a diaphragm ring, wherein the diaphragm ring holds the diaphragm at a predetermined tension;

a fixed electrode provided opposite to the diaphragm with a gap therebetween, the fixed electrode and the diaphragm defining a capacitor;

a unit casing accommodating the diaphragm ring, the diaphragm, and the fixed electrode;

a fixing ring fixed to the unit casing, the fixing ring indirectly fixing the diaphragm ring to an interior of the unit casing;

a projected portion projecting from a second surface of the diaphragm ring, wherein the second surface is opposite to the first surface of the diaphragm ring;

a planar ring portion comprising the fixing ring; and a plurality of projections comprising the fixing ring, the plurality of projections projecting from an internal periphery of the planar ring portion and being provided in a circumferential direction, wherein the plurality of projections urges the projected portion of the diaphragm ring toward the fixed electrode.

2. The condenser microphone unit according to claim 1, wherein the fixing ring comprises a resilient metal plate.

3. The condenser microphone unit according to claim 1, wherein the plurality of projections project at a predetermined angle relative to a flat surface of the planar ring portion.

4. The condenser microphone unit according to claim 2, wherein the plurality of projections project at a predetermined angle relative to a flat surface of the planar ring portion.

5. The condenser microphone unit according to claim 1, wherein the plurality of projections are flush with the planar ring portion.

6. The condenser microphone unit according to claim 2, wherein the plurality of projections are flush with the planar ring portion.

7. The condenser microphone unit according to claim 3, wherein a ring metal washer is disposed between the fixing ring and the unit casing.

8. The condenser microphone unit according to claim 5, wherein a ring metal washer is disposed between the fixing ring and the unit casing.

9. The condenser microphone unit according to claim 1, wherein the fixed electrode has a support projection along a periphery thereof and the plurality of projections urge the diaphragm ring toward the support projection.

10. The condenser microphone unit according to claim 3, wherein the fixed electrode has a support projection along a periphery thereof and the plurality of projections urge the diaphragm ring toward the support projection.

11. The condenser microphone unit according to claim 4, wherein a ring metal washer is disposed between the fixing ring and the unit casing.

12. The condenser microphone unit according to claim 11, wherein the fixed electrode has a support projection along a periphery thereof and the plurality of projections urge the diaphragm ring toward the support projection.

13. The condenser microphone unit according to claim 5, wherein the fixed electrode has a support projection along a periphery thereof and the plurality of projections urge the diaphragm ring toward the support projection.

14. The condenser microphone unit according to claim 6, wherein a ring metal washer is disposed between the fixing ring and the unit casing.

15. The condenser microphone unit according to claim 14, wherein the fixed electrode has a support projection along a periphery thereof and the plurality of projections urge the diaphragm ring toward the support projection.

16. The condenser microphone unit according to claim 9, wherein the plurality of projections urge the diaphragm ring at positions opposite to the support projection of the fixed electrode.

17. The condenser microphone unit according to claim 16, wherein the fixing ring comprises a resilient metal plate.

18. A condenser microphone comprising:

a condenser microphone unit, wherein the condenser microphone unit comprises:

a diaphragm pasted to a first surface of a diaphragm ring, wherein the diaphragm ring holds the diaphragm at a predetermined tension;

a fixed electrode provided opposite to the diaphragm with a gap therebetween, the fixed electrode and the diaphragm defining a capacitor;

a unit casing accommodating the diaphragm ring, the diaphragm, and the fixed electrode;

a fixing ring fixed to the unit casing, the fixing ring indirectly fixing the diaphragm ring to an interior of the unit casing;

a projected portion projecting from a second surface of the diaphragm ring, wherein the second surface is opposite to the first surface of the diaphragm ring;

a planar ring portion comprising the fixing ring; and a plurality of projections comprising the fixing ring, the plurality of projections projecting from an internal periphery of the planar ring portion and being provided in a circumferential direction, wherein the plurality of projections urges the projected portion of the diaphragm ring toward the fixed electrode.

19. The condenser microphone according to claim 18, wherein the plurality of projections project at a predetermined angle relative to a flat surface of the planar ring portion.

20. The condenser microphone according to claim 18, wherein the plurality of projections are flush with the planar ring portion.

* * * * *